US010639221B2

(12) United States Patent
Kramer et al.

(10) Patent No.: US 10,639,221 B2
(45) **Date of Patent: *May 5, 2020**

(54) ADJUSTABLE FOUNDATION AND MATTRESS ASSEMBLY

(71) Applicant: Dreamwell, Ltd., Las Vegas, NV (US)

(72) Inventors: Kenneth L. Kramer, Greensburg, IN (US); Jeffrey M. Woodall, Greenfield, IN (US); Francis Jan, Atlanta, GA (US)

(73) Assignee: DREAMWELL, LTD., Doraville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/672,409

(22) Filed: Aug. 9, 2017

(65) Prior Publication Data

US 2017/0333271 A1 Nov. 23, 2017

Related U.S. Application Data

(63) Continuation-in-part of application No. 15/051,972, filed on Feb. 24, 2016, now Pat. No. 10,506,884.

(51) Int. Cl.
*A61G 7/015* (2006.01)
*A61G 7/018* (2006.01)
(Continued)

(52) U.S. Cl.
CPC ..... *A61G 7/015* (2013.01); *A47C 20/041* (2013.01); *A47C 20/08* (2013.01); *A61G 7/018* (2013.01);
(Continued)

(58) Field of Classification Search
CPC ..... A47C 20/08; A47C 20/10; A47C 20/12; A47C 20/041; A47C 19/025; A47C 19/04;
(Continued)

(56) References Cited

U.S. PATENT DOCUMENTS 4,095,296 A 6/1978 Ferro
4,385,410 A 5/1983 Elliott et al.
(Continued)

FOREIGN PATENT DOCUMENTS

WO 2002076367 A2 10/2002

OTHER PUBLICATIONS

Notification of Transmittal of the International Search Report and the Written Opinion of the International Searching Authority, Or the Declaration, issued in International Application No. PCT/US2017/018774, dated May 24, 2017; 6 pages.
(Continued)

*Primary Examiner* — Nicholas F Polito
*Assistant Examiner* — Rahib T Zaman
(74) *Attorney, Agent, or Firm* — Cantor Colburn LLP

(57) ABSTRACT

A coil spring mattress and adjustable foundation assembly includes a coil spring mattress; and an adjustable foundation including a mattress support surface including a head and back section hingedly connected to an intermediate section at one end and a leg and foot section hingedly connected to the intermediate section at another end, wherein the intermediate section includes a first portion and a second portion. The intermediate or seat section is configured to increase in length upon articulation of the head and back section and/or the leg and foot section from a flat position or an increase in inclination of any section. Likewise, the intermediate or seat section is configured to decrease in length upon articulation of the head and back section and/or the leg and foot section from an inclined position to a flat position or a decrease in length upon declination of any section.

16 Claims, 16 Drawing Sheets

(51) Int. Cl.

| | |
|---|---|
| ***A47C 20/04*** | (2006.01) |
| ***A61G 7/07*** | (2006.01) |
| ***A47C 20/08*** | (2006.01) |
| ***A61H 23/02*** | (2006.01) |

(52) U.S. Cl.
CPC ..... *A61G 7/07* (2013.01); *A61H 23/0263* (2013.01); *A61G 2203/70* (2013.01); *A61H 2201/0142* (2013.01); *A61H 2201/0192* (2013.01); *A61H 2201/5005* (2013.01); *A61H 2205/02* (2013.01); *A61H 2205/081* (2013.01); *A61H 2205/10* (2013.01); *A61H 2205/12* (2013.01)

(58) Field of Classification Search
CPC .... A47C 19/045; A47C 21/006; A61G 7/015; A61G 7/018; A61G 7/07; A61G 2203/70; A61H 23/0263; A61H 2201/0142; A61H 2201/0192; A61H 2201/5005; A61H 2005/02; A61H 2005/081; A61H 2005/10; A61H 2005/12
See application file for complete search history.

(56) References Cited

U.S. PATENT DOCUMENTS

| | | | | |
|---|---|---|---|---|
| 5,245,718 | A | 9/1993 | Krauska | |
| 5,315,726 | A * | 5/1994 | Borenstein | A47C 19/22 297/161 |
| 5,437,607 | A * | 8/1995 | Taylor | A61H 1/00 5/915 |
| 5,535,464 | A * | 7/1996 | Salonica | A61G 7/015 5/604 |
| 5,806,114 | A * | 9/1998 | Morgan | A61G 13/0009 5/602 |
| 5,926,875 | A * | 7/1999 | Okamoto | A61G 7/02 5/604 |
| 6,000,077 | A | 12/1999 | Cyr | |
| 6,006,379 | A | 12/1999 | Hensley | |
| 6,393,641 | B1 | 5/2002 | Hensley | |
| 6,499,161 | B1 | 12/2002 | Godette | |
| 6,637,055 | B1 * | 10/2003 | Nanan | A61H 1/0218 482/144 |
| 6,874,182 | B2 | 4/2005 | L'Hegarat et al. | |
| 7,036,166 | B2 * | 5/2006 | Kramer | A61G 7/015 5/617 |
| 7,930,780 | B2 | 4/2011 | Clenet | |
| 8,418,290 | B2 | 4/2013 | Shih | |
| 8,424,134 | B2 * | 4/2013 | Byun | A61G 7/0005 5/236.1 |
| 8,510,881 | B1 * | 8/2013 | Lee | A61G 7/02 5/308 |
| 8,578,530 | B2 * | 11/2013 | Patwardhan | A61G 7/015 5/604 |
| 8,640,285 | B2 | 2/2014 | Heimbrock et al. | |
| 8,806,682 | B2 | 8/2014 | Hornbach et al. | |
| 9,049,942 | B2 | 6/2015 | Huang | |
| 9,913,545 | B2 * | 3/2018 | Loewen | A47C 20/04 |
| 10,506,884 | B2 | 12/2019 | Kramer | |
| 2003/0121104 | A1 * | 7/2003 | Bretschger | A47C 21/006 5/694 |
| 2006/0021142 | A1 * | 2/2006 | Hornbach | A47C 19/045 5/600 |
| 2006/0026762 | A1 * | 2/2006 | Hornbach | A47C 19/045 5/611 |
| 2006/0026763 | A1 | 2/2006 | Mossbeck | |
| 2006/0026765 | A1 * | 2/2006 | Hornbach | A61G 7/015 5/618 |
| 2006/0031991 | A1 * | 2/2006 | McDaniel | A61G 7/015 5/611 |
| 2008/0229502 | A1 * | 9/2008 | Johnson | A61G 7/02 5/604 |
| 2009/0019640 | A1 | 1/2009 | Neuenswander | |
| 2009/0094744 | A1 * | 4/2009 | Benzo | A61G 7/008 5/608 |
| 2009/0178201 | A1 | 7/2009 | Lujan et al. | |
| 2014/0075674 | A1 * | 3/2014 | Chun | A61G 7/018 5/618 |
| 2014/0317848 | A1 * | 10/2014 | Kay | A61G 7/005 5/611 |
| 2015/0190306 | A1 * | 7/2015 | Krueger | A61H 23/00 5/618 |
| 2016/0029807 | A1 * | 2/2016 | Nomura | A61G 7/015 5/412 |
| 2016/0058639 | A1 * | 3/2016 | Lacasse | A61G 7/005 5/610 |
| 2016/0262548 | A1 | 9/2016 | Broom et al. | |

OTHER PUBLICATIONS

Written Opinion of the International Searching Authority issued in International Application No. PCT/US2017/018774, dated May 24, 2017; 7 pages.
Invitation to Pay Additional Fees for International Patent Application No. PCT/US18/046014 dated Oct. 23, 2018.
International Preliminary Report on Patentability for Application No. PCT/US17/018774 dated Sep. 7, 2018.
Non-Final Office Action for U.S. Appl. No. 15/051,972 dated Mar. 20, 2018.
Non-Final Office Action for U.S. Appl. No. 15/687,840 dated Oct. 5, 2018.
Search Report for International Application No. PCT/US2018/046014, dated Dec. 14, 2018 (8 pages).
Written Opinion for International Application No. PCT/US2018/046014, dated Dec. 14, 2018 (10 pages).
Notification Concerning Transmittal of International Preliminary Report on Patentability (Chaper I of the Patent Cooperation Treaty), issued International Application No. PCT/US2018046014, dated Feb. 20, 2020; 11 pages.

* cited by examiner

ADJUSTABLE FOUNDATION AND MATTRESS ASSEMBLY

CROSS REFERENCE TO RELATED APPLICATIONS

The present application is a continuation-in-part application of and claims priority to U.S. application Ser. No. 15/051,972, filed on Feb. 24, 2016, the contents of which are incorporated by reference in its entirety.

BACKGROUND

The present disclosure generally relates to mattress assemblies, and more particularly, to coil spring mattress assemblies including an adjustable foundation.

Adjustable mattress assemblies, also commonly referred to as articulating beds are commonly used in the healthcare field and in residential applications. A typical adjustable mattress assembly includes a base and an adjustable mattress frame or support, which is divided into a head and back section, an intermediate seat section, and a leg and foot section. The mattress frame sections are pivotally interconnected and have a continuous range of adjustment. The sections are moveable from a flat, user resting position to a seated position with the legs bent or the legs straight and the occupant's back angled upwardly with respect to the seat section. The sections are pivoted by motor drives, hand operated cranks or through the user's weight.

BRIEF SUMMARY

Disclosed herein is a coil spring mattress and adjustable foundation assembly and process of operation. In one embodiment, the coil spring mattress and adjustable foundation assembly includes a coil spring mattress; and an adjustable foundation frame. The adjustable foundation frame includes side frame members and transverse frame members attached at respective ends of the side frame members to define a generally rectangular shape, and at least one cross rail extending between the side frame members; a mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section; and a first actuator having an extending and retracting member operatively coupled to a linkage assembly to effect inclination or declination of the head and back section relative to the intermediate seat section and inclination or declination of the foot and leg section, wherein the first actuator is further operative to effect an increase or decrease in a length of the intermediate seat section by movement of the first portion relative to the second portion.

In another embodiment, the coil spring mattress and adjustable foundation includes the coil spring mattress; and a foundation frame including side frame members and transverse frame members attached at respective ends of the side frame members to define a generally rectangular shape, and at least one cross rail extending between the side frame members; a mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section; a first actuator having an extending and retracting member operatively coupled to the linkage assembly to effect selective inclination or declination of the head and back section relative to the intermediate seat section, wherein the first actuator is further operative to effect an increase or decrease in a length of the intermediate seat section by movement of the first portion relative to the second portion; and a second actuator having an extending and retracting member operatively coupled to the linkage assembly to effect selective inclination or declination of the leg and foot section.

The process for operating a coil spring mattress and adjustable foundation assembly includes changing an angle of a head and back section relative to an intermediate seat section of an adjustable foundation, the adjustable foundation comprising a mattress support surface including the head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section; and lengthening the intermediate seat section upon inclining the head and back section by moving the first portion away from the second portion; or shortening the intermediate seat section upon declining the head and back section by moving the first portion towards the second portion, wherein a coil spring mattress remains flush with a terminal end of the head and back section during the changing of the angle of the head and back section relative to the intermediate seat section.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
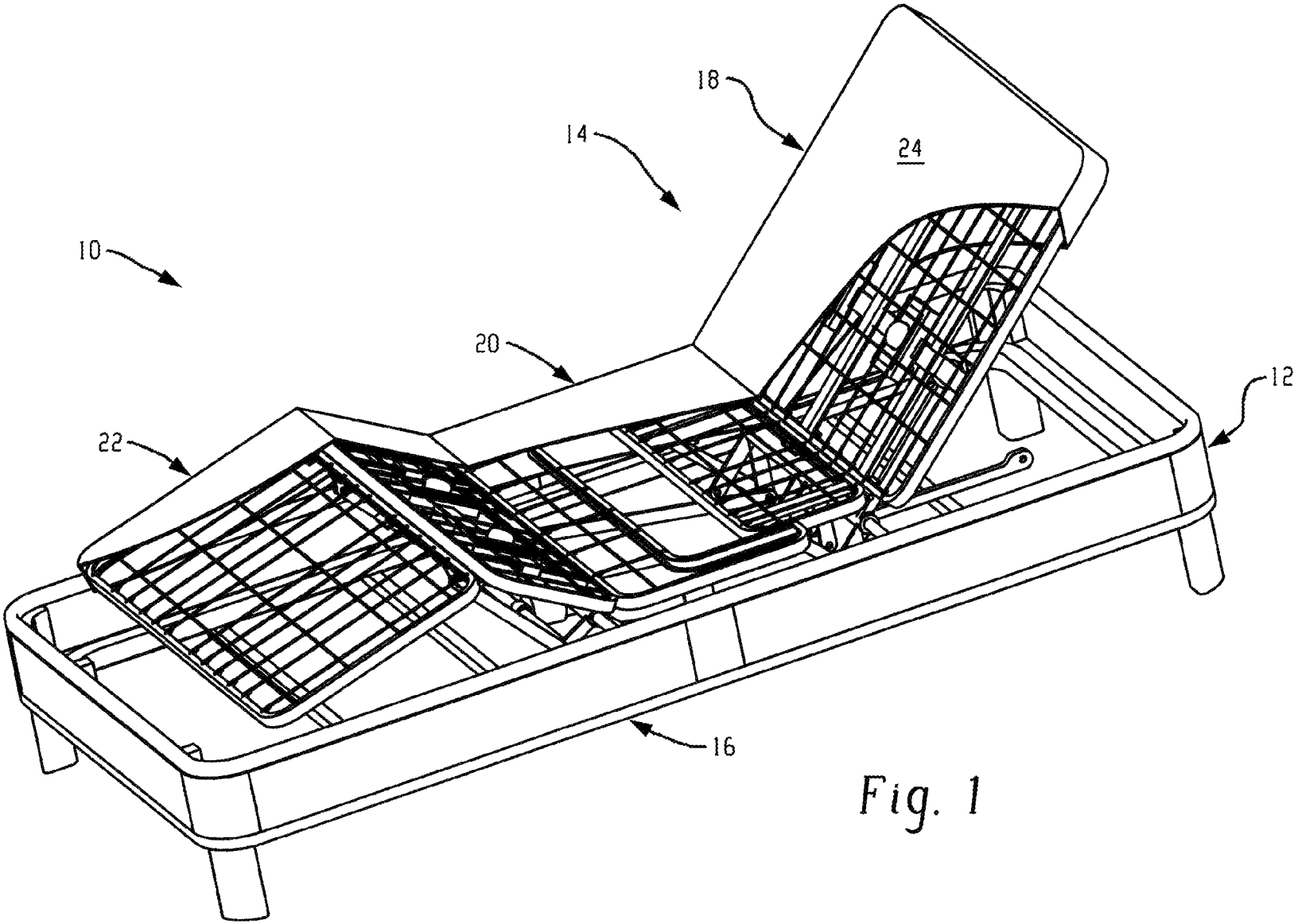
FIG. 1 ("FIG.") is a perspective view of an adjustable foundation including a partial cutaway of a cover in accordance with the present disclosure.
Figure 2:
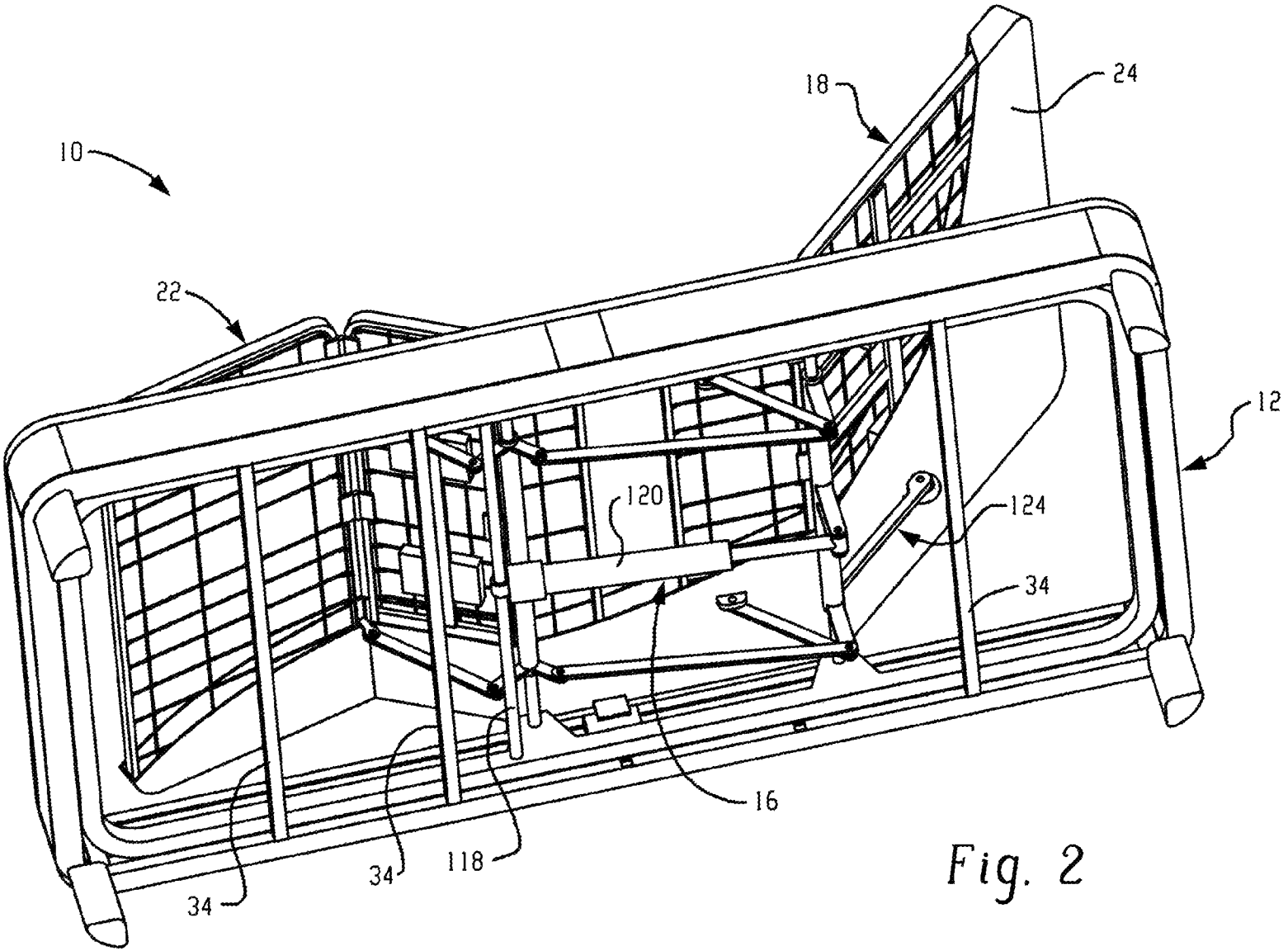
FIG. 2 is a perspective view illustrating the bottom of the adjustable foundation including the partial cutaway of the cover.

Referring now to FIGS. 1-2, there is shown a perspective view of an adjustable mattress foundation 10 in accordance with the present disclosure. The adjustable mattress foundation 10 is movable between a fully horizontal position and a fully inclined position (FIG. 1), wherein the head and section and the leg and foot section are shown elevated relative to the intermediate seat section. An operator or user may sleep with the adjustable bed 10 generally in its fully horizontal position, in the fully inclined position, or in any position therebetween.

The adjustable mattress foundation 10 includes a generally rectangular foundation frame 12, a mattress support surface 14, and a linkage assembly 16 (shown more clearly in FIG. 2). The linkage assembly 16 is operable to articulate the various sections of the mattress support surface 14, which can include a head and back section 18, an intermediate seat section 20, and a leg and foot section 22. A covering 24 is disposed about the various sections 18, 20 and 22, wherein a partial cutaway view is provided in the Figures. The covering may be padded and may include a rigid substrate such as wood or plastic. Advantageously, the intermediate seat section 20 is formed of two pieces configured to increase in length upon articulation of the head and back section 18 and/or the leg and foot section 22 from a flat position or an increase in inclination. Likewise, the intermediate seat section 20 is configured to decrease in length upon articulation of the head and back section 18 and/or the leg and foot section 22 from an inclined position to a flat position or a decrease in length upon declination of any section. By doing so, a prone user does not have to shift his position on the mattress in order to accommodate the inclination or declination. Additionally and surprisingly, a coil spring mattress disposed thereon has been found to better contour to the shape provided by the different sections during articulation, which also helps minimize pinch points as will be described in more detail below.

Figure 3:
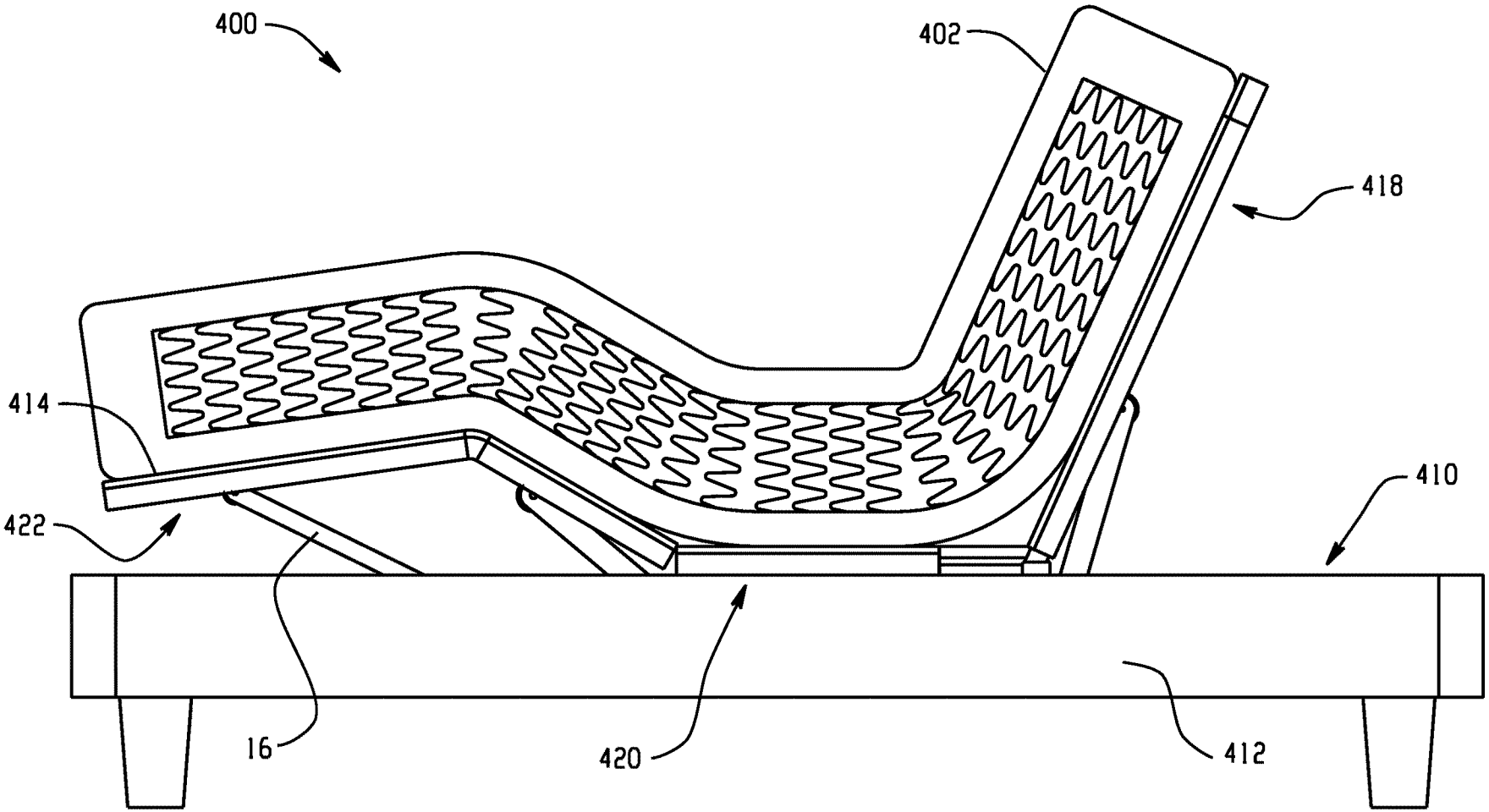
FIG. 3 is a side sectional view of a coil spring mattress and adjustable foundation assembly in accordance with the present disclosure.
Figure 4:
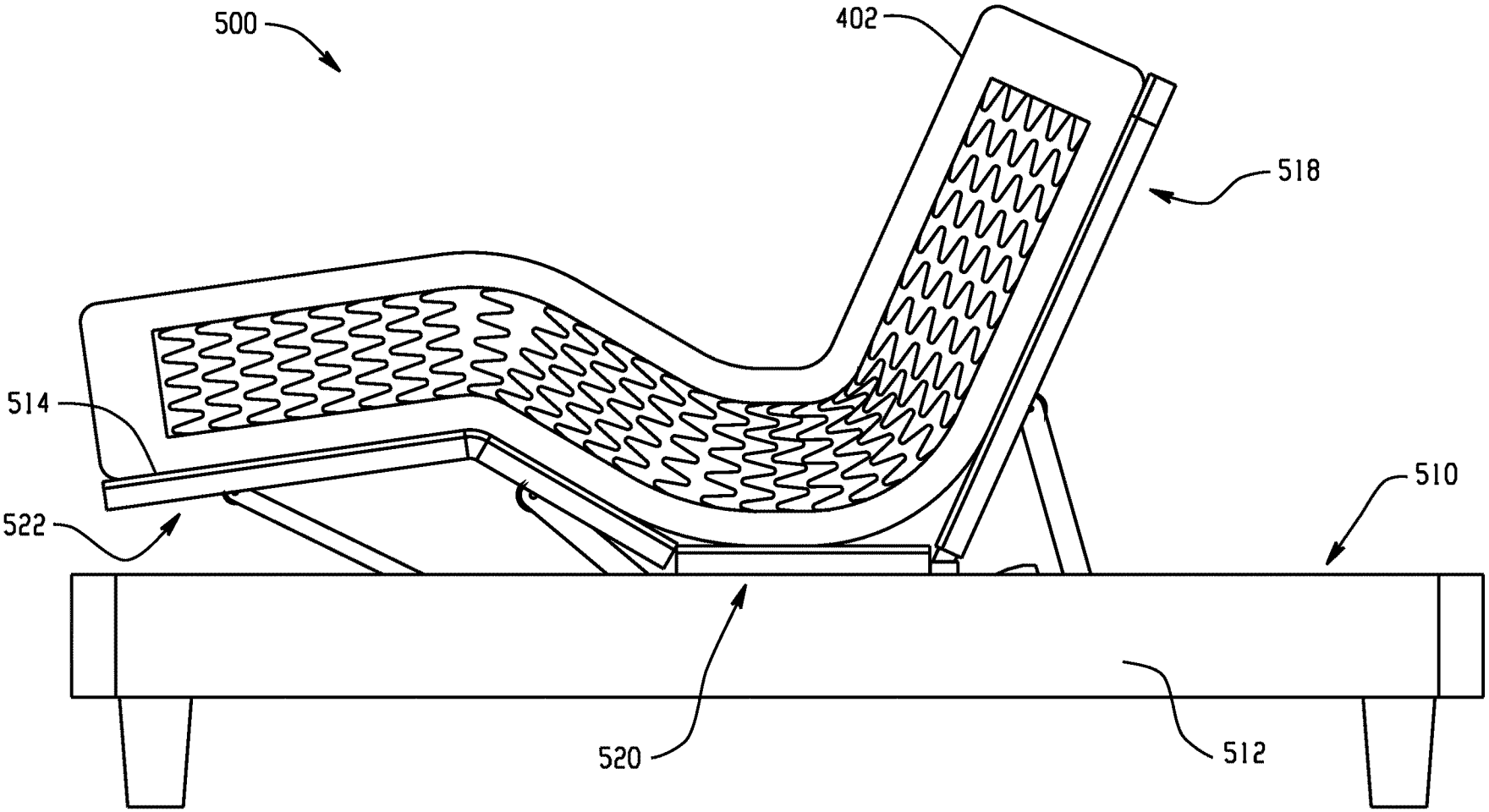
FIG. 4 is a side sectional view of a coil spring mattress and adjustable foundation assembly in accordance with the prior art.

FIGS. 3 and 4 provide side sectional views of coil spring mattresses seated on adjustable foundations at an inclined position in accordance with the present disclosure and in accordance with the prior art, respectively. The coil spring mattress-adjustable foundation assembly 400 of the present disclosure includes an adjustable foundation 410 having the feature of the increased length of the intermediate seat section and the prior art coil spring mattress-adjustable foundation assembly 500 includes an adjustable foundation 510 having a static intermediate seat section, i.e., the length of the intermediate sect section does not change upon articulation.

The adjustable foundation 410 of the exemplary coil spring mattress-adjustable foundation assembly 400 can include a similar construction to adjustable foundation 10, for example. As such, the adjustable foundation 410 includes a generally rectangular foundation frame 412, a mattress support surface 414 upon which a coil spring mattress 402 is supported, and a linkage assembly 416 (a portion of which is shown). The linkage assembly 416 is operable to articulate the various sections of the mattress support surface 414, which includes a head and back section 418, an intermediate seat section 420, and a leg and foot section 422. As noted above and described more fully below, the intermediate seat section 420 can formed of two pieces configured to increase in length upon articulation of the head and back section 418 and/or the leg and foot section 422 from a flat position or any increase in inclination. The head and back section 418 of the illustrated coil spring mattress-adjustable foundation assembly is at a 65 degree angle and the leg section of the leg and foot section is at a 30 degree relative to a horizontal plane defined by ground.

In contrast, the adjustable foundation 510 of the prior art coil spring mattress-adjustable foundation assembly 500 includes a generally rectangular foundation frame 512, a mattress support surface 514 upon which the same coil spring mattress 402 as depicted in FIG. 3 is supported, and a linkage assembly 516 (a portion of which is shown). The linkage assembly 516 is operable to articulate the various sections of the mattress support surface 514, which includes a head and back section 518, an intermediate seat section 520, and a leg and foot section 522. The intermediate seat section 520 is static and does not increase or decrease in length upon articulation of the head and back section 518 and/or the leg and foot section 522. The head and back section 518 of the illustrated coil spring mattress-adjustable foundation assembly 500 is at a 65 degree angle and the leg section of the leg and foot section is at a 30 degree relative to a horizontal plane defined by ground.

Compared to the prior art adjustable foundation 510 without the extendible intermediate seat section 520, the adjustable foundation of the present disclosure provides the intermediate seat section 420 with increased distance upon inclination, which enables an increased bend radius of curvature and improved coil behavior for the coil spring mattress 402 when seated thereon. Less constraint and compression is observed while increasing the longevity of the coils. The less constraint translates to increased comfort level to the user. Moreover, by increasing the length of the intermediate section 420 relative to the head and back section 418 the sliding of the coil spring mattress 402 against the head and back section 418 that would typically occur with prior art coil spring/adjustable foundation assemblies 500 is substantially decreased or eliminated, which reduces wear and tear on the head and back section. Still further, the coil spring mattress 402 contours gently with the exemplary coil spring mattress-adjustable foundation assembly 400 and remains flush with the terminal end of the head and back section 418 as shown, thereby improving aesthetics of the coil spring adjustable foundation assembly.

As shown in FIG. 4, the prior art coil spring mattress-adjustable foundation assembly 500 results in a tighter radius of curvature due to the static non-extendible configuration of the intermediate seat section 520, which significantly affects contour of the mattress 402 when at an inclined position. The shorter distance can result in lift off (poor contouring) depending on the properties the coil spring mattress. Moreover, the user can feel pinched at the surface of the coil spring mattress 402 of the prior art mattress-adjustable foundation assembly 500 depending on the degree of inclination. Still further, inclination of the prior art coil spring mattress-adjustable foundation assembly 500 causes the coil spring mattress 402 to slide beyond the terminal end of the head and back section 518 as shown, which can affect the aesthetics as well as causing the sheets covering the coil spring mattress to become undone.

The coil spring mattresses 402 are not intended to be limited so long as the coil spring mattress includes coil springs. Suitable coil spring mattresses can include any spring coil system, such as for example Bonnell coils, Marshall coils, offset coils, continuous coils, pocketed coils, asymmetric coils, stacked coils, among others. Exemplary coil spring mattresses and/or coil springs are disclosed in U.S. Pat. Nos. 3,080,578, 3,138,807, 3,230,558, 3,251,077, 8,099,811, 9,161,634, 7,814,594, 8,979,079, 6,944,899, 8,689,380, 6,932,685, 9,427,091, 9,504,332, 8,474,805, 8,292,753, 7,047,581, 6,760,940, 9,314,108, 7,165,282, 9,226,591, 9,119,478, 9,314,109, 9,259,097, 7,096,528, 9,498,069, 8,356,372, 9,622,590, 7,395,568, 7,740,866, 7,624,469, and 8,127,383, incorporated herein by reference in their entireties.

Figure 5:
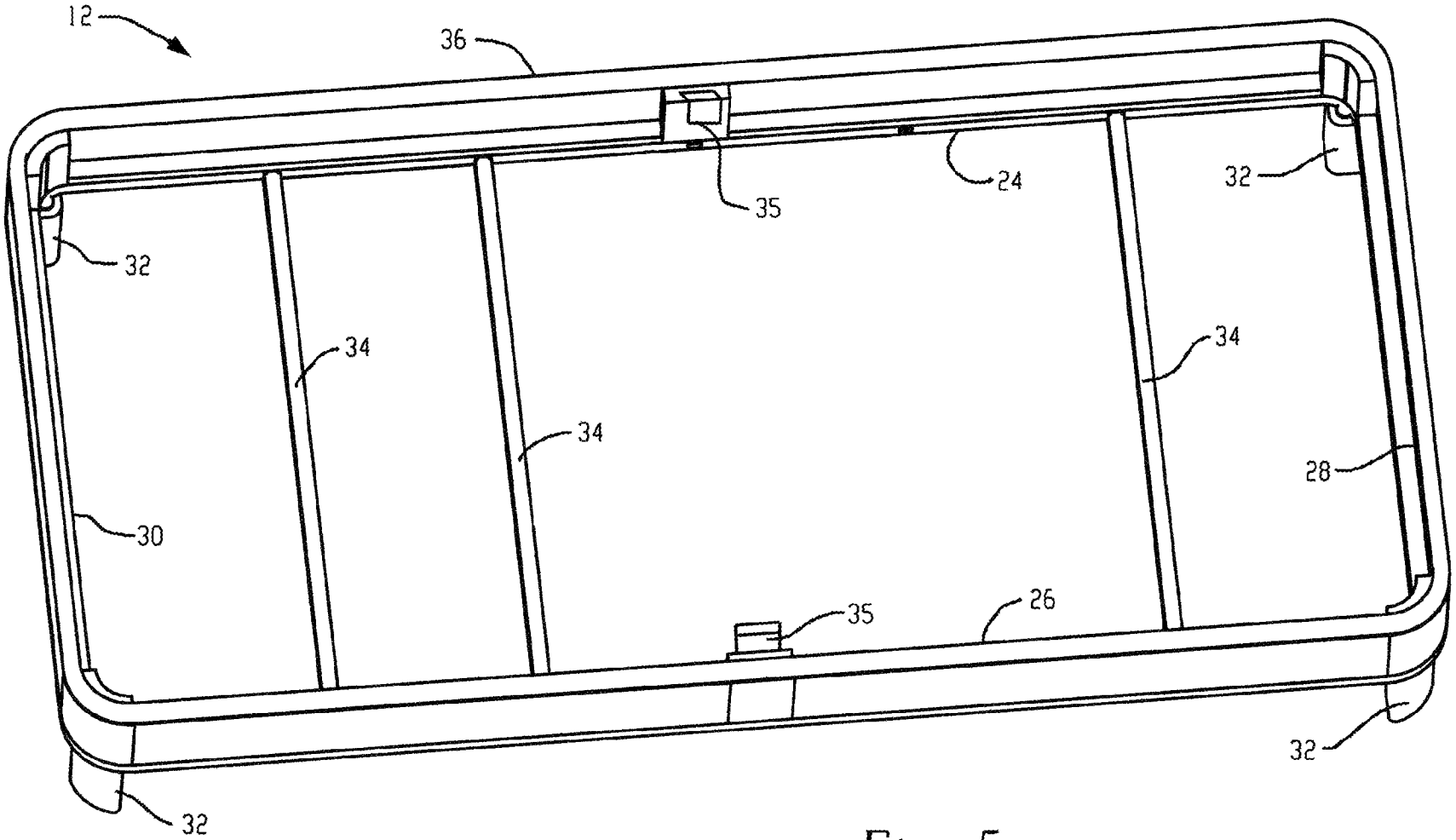
FIG. 5 is a perspective view of a foundation frame for the adjustable mattress.

As shown in FIG. 5, the generally rectangular foundation frame 12 generally includes side frame members 24, 26, transverse frame members 28, 30 attached to respective ends of the side frame members to define the generally rectangular shape to the foundation frame 10, and support legs 32 at corners of the foundation frame 12 for elevating the foundation frame relative to ground. The support legs 32 may be secured to the frame members. The foundation frame 12 further includes one or more cross rails 34 extending from one side rail 24 to the other side rail 26. A frame casing 36 is disposed about a perimeter of the foundation frame 12 and has a width sufficient to shield the linkage assembly 16 from view when the various sections 18, 20, 22 of the mattress support surface 14 is in a flat position. The frame casing 36 as shown extends upward from the foundation frame, i.e., the frame casing 36 is attached at about a lower surface thereof to the foundation frame 12. The cross rails 34 are spaced about and are configured to provide additional support to the mattress support surface 14 as well as provide an opening sufficient to accommodate the linkage assembly 16, which primarily underlies the intermediate or seat portion 20. As shown, two cross rails 34 are spaced apart from one another and generally positioned to support the leg and foot section 22, and one cross rail is generally positioned to support the head and back section 18. However, it should be apparent that more or less cross rails could be utilized.

Figure 6:
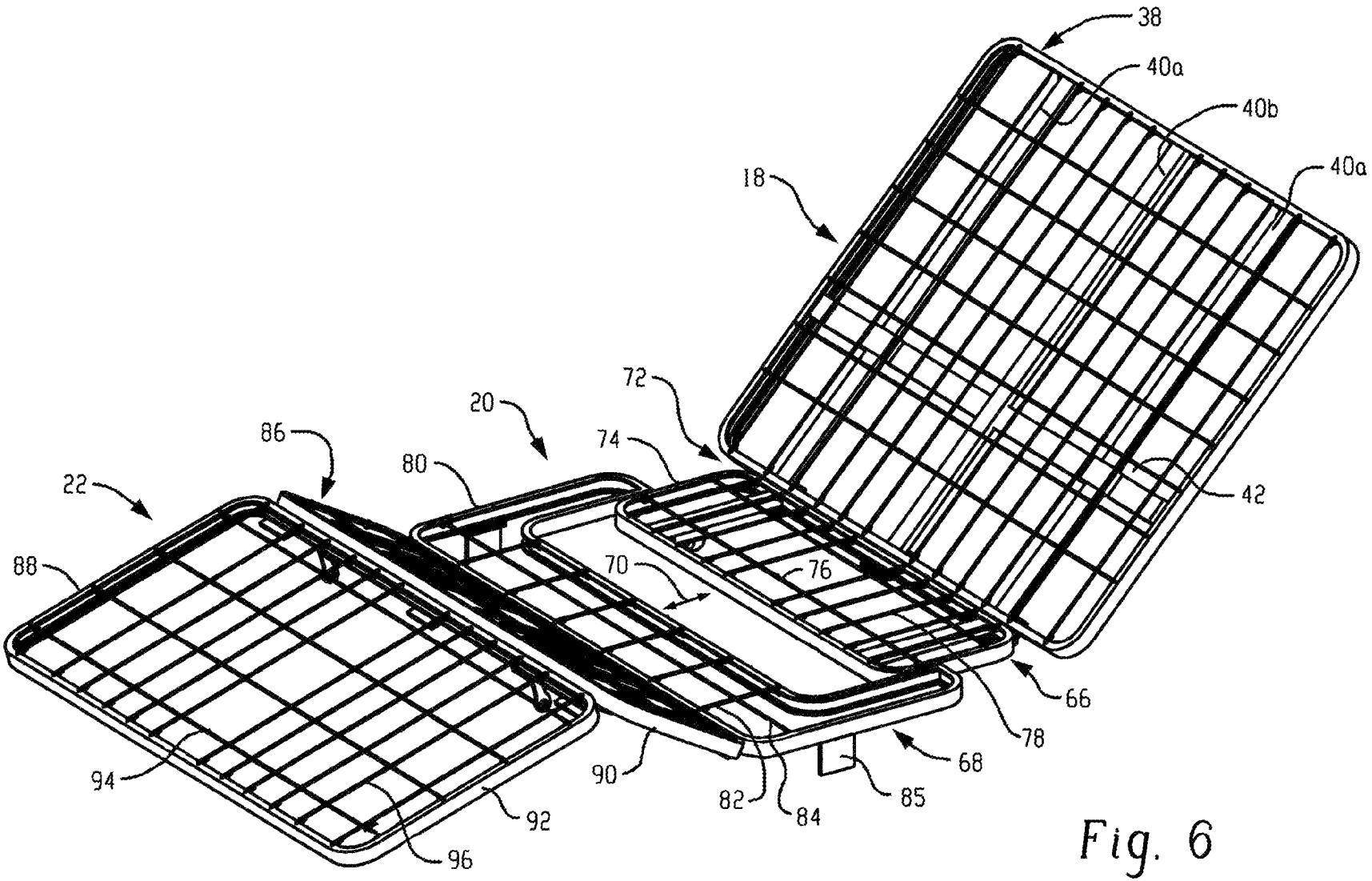
FIG. 6 is a perspective view of a mattress support surface including a head and back section, an intermediate or seat section, and a leg and foot section.

As shown more clearly in FIG. 6, the illustrated head and back section 18 includes a rigid frame 38 including three longitudinal cross members 40 extending from one side of the frame to an opposing side and a transverse cross bar 42. At least two of the longitudinal cross members 40*a* are equally spaced from a midline of the rigid frame and positioned to be in general alignment with a roller arm of the linkage assembly 16. As will be discussed in greater detail below, the roller arm engages the longitudinal cross member of the head and back section during operation thereof. The third longitudinal cross member 40*b* may be at a midline of the rigid frame 38, which provides additional support to the frame. Transverse cross bar 42 is disposed at a lower portion of the rigid frame. The rigid frame 38 has a width dimension about equal to a width of a mattress to be used with the adjustable foundation. The length of the rigid frame 38 is generally dimensioned to at least accommodate the length of a typical user's head and back section. A plurality of transverse and longitudinal wires 44, 46, respectively, may be coupled to a top surface of the rigid frame 40 so as to provide additional support to the mattress when in use.

Figure 7:
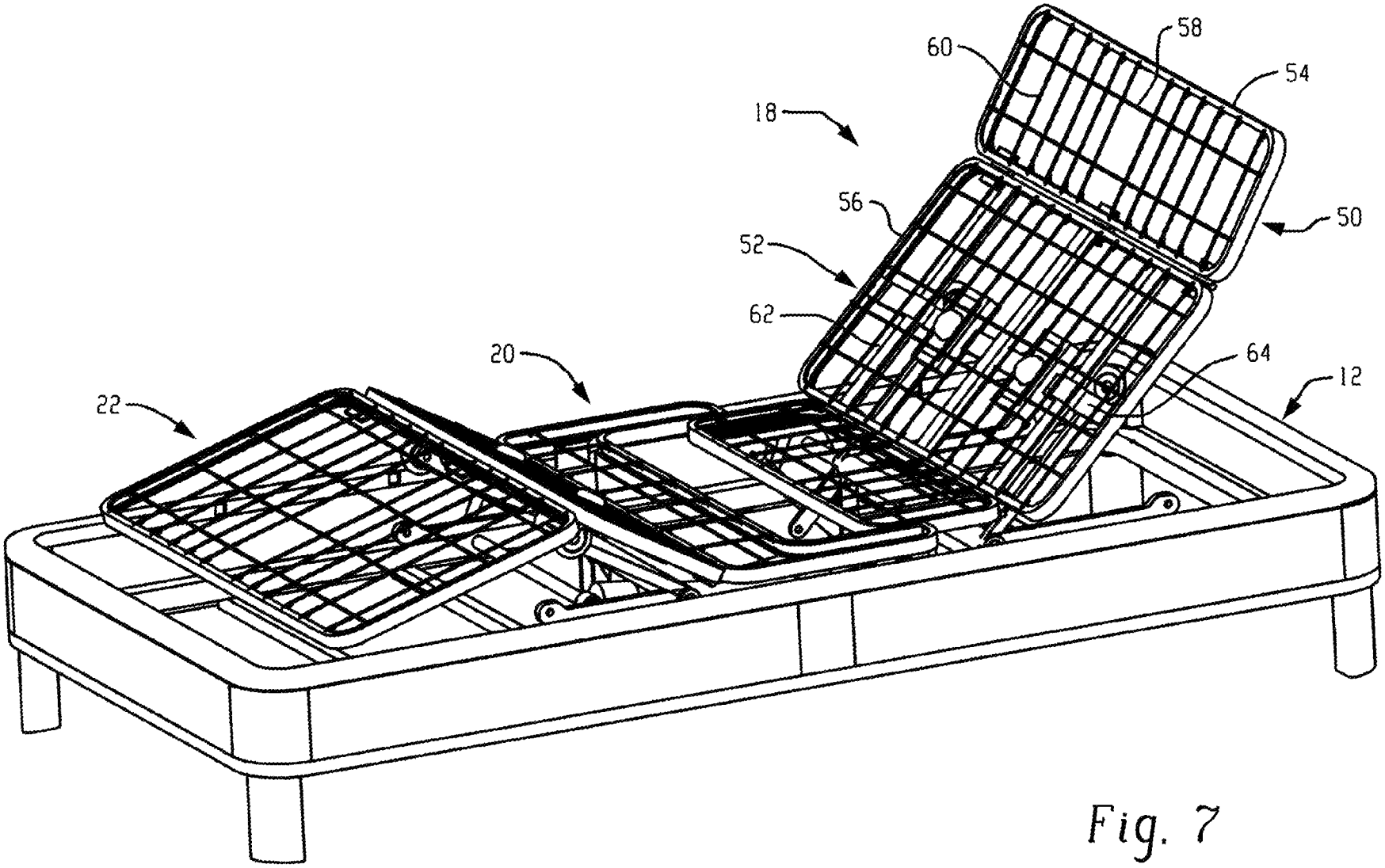
FIG. 7 is a perspective view of the adjustable foundation without the partial cutaway of the cover.

In another embodiment, the head and back section 18 includes a powered head tilt as is generally shown in FIG. 7. The head and back section 18 includes a first portion 50 hingedly connected to a second portion 52. An actuator via a link arm (not shown) is coupled to the first portion 50 to effect movement thereof relative to the second portion 52. Each portion 50, 52 includes a rigid frame 54, 56, respectively, wherein the rigid frame 54 of the first portion 50 is dimensioned to articulate an end of the mattress disposed thereon, e.g., the user head region and the rigid frame 56 of the second portion 52 is generally dimensioned to accommodate the lumbar region of a user. Each portion may further include a plurality of transverse and longitudinal wires 58, 60, respectively, coupled to a top surface of the rigid frame. The second portion 52, which bears the greatest weight load relative to the first portion 50 when in use, includes three longitudinal cross members 62 extending from one side of the frame to an opposing side and a transverse cross bar 64, which has a similar function as the embodiment described in FIG. 6.

Referring back to FIG. 6, the intermediate seat section 20 includes a first portion 66 and a second portion 68, wherein the first and second portions collectively define the seat section 20 and function to increase a length of the intermediate seat section 20 when the adjustable foundation 10 is raised from a flat position to an inclined position. In a similar manner, the first and second portions 66, 68, respectively, function to shorten a length of the intermediate or seat section 20 when the adjustable foundation 10 is declined, e.g., from an inclined position to a flat position. The increase or decrease in length is represented by arrow 70. The first portion 66 includes a rigid frame 74 hingedly connected at one end to the head and back section rigid frame 38 such that the head and back section 18 pivots at pivot point 72 when inclined or declined. The other frame end is a free end and is close to or abuts the second portion 68 when the adjustable foundation 12 is in a flat position. The rigid frame 74 may further include a plurality of transverse and longitudinal wires 76, 78, respectively, coupled to a top surface thereof. Advantageously, the motion and extension of the first portion 66 of the intermediate seat section 20 causes the head and back section 18 to slide towards the wall, which helps to counteract the amount of distance that the mattress is traveling away from the headboard in order for the occupant to maintain proximity to the night stand. The motion and extension of the first portion 66 eliminates the need for an additional retracting frame.

The second portion 68 includes u-shaped rigid frame 80 and is hingedly connected to the leg and foot section 36 at one end. The other end includes an opening defined by the u-shaped rigid frame. During operation, the first portion 66 is dimensioned to laterally move within the u-shaped opening provided in the second portion 68, wherein the second portion 68 is stationary. The rigid frame 80 may further include a plurality of transverse and longitudinal wires 82, 84, respectively, coupled to a top surface thereof. Coupled thereto are support members 85, which are configured to seat upon the side members 24, 26 of the foundation frame 12 when assembled so as to provide additional support.

The leg and foot section 22 includes first and second portions 86, 88 hingedly connected to one another, wherein first portion 86 is also hingedly connected to the intermediate seat section 20 as described above. Similar to the sections 18, 20 above, the first and second portions 86, 88 of the leg and foot section 22 include rigid frames 90, 92, respectively, and a plurality of transverse and longitudinal wires 94, 96, respectively, coupled to a top surface thereof.

Figure 8:
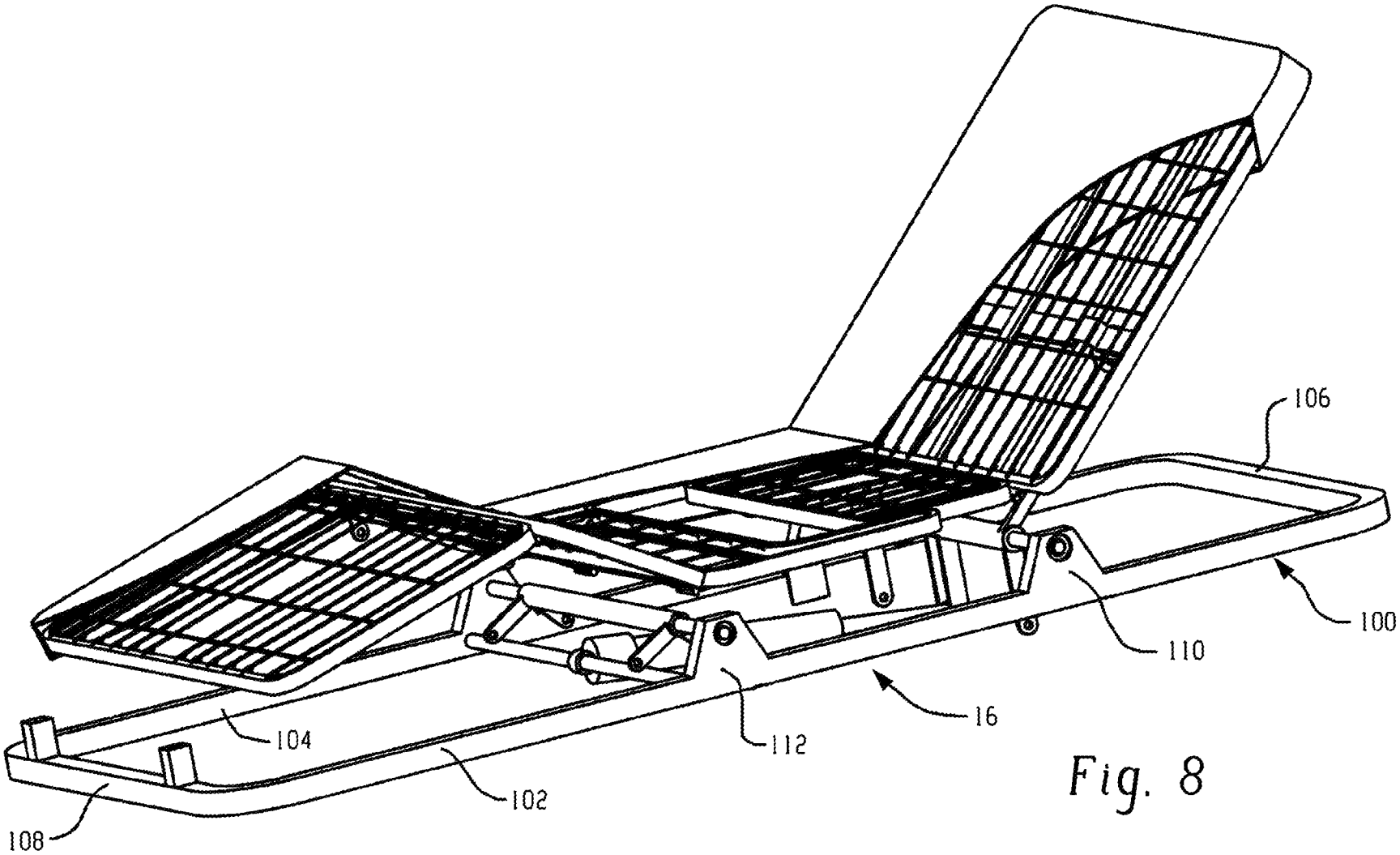
FIG. 8 is a perspective view of the mattress support surface and the linkage assembly.
Figure 9:
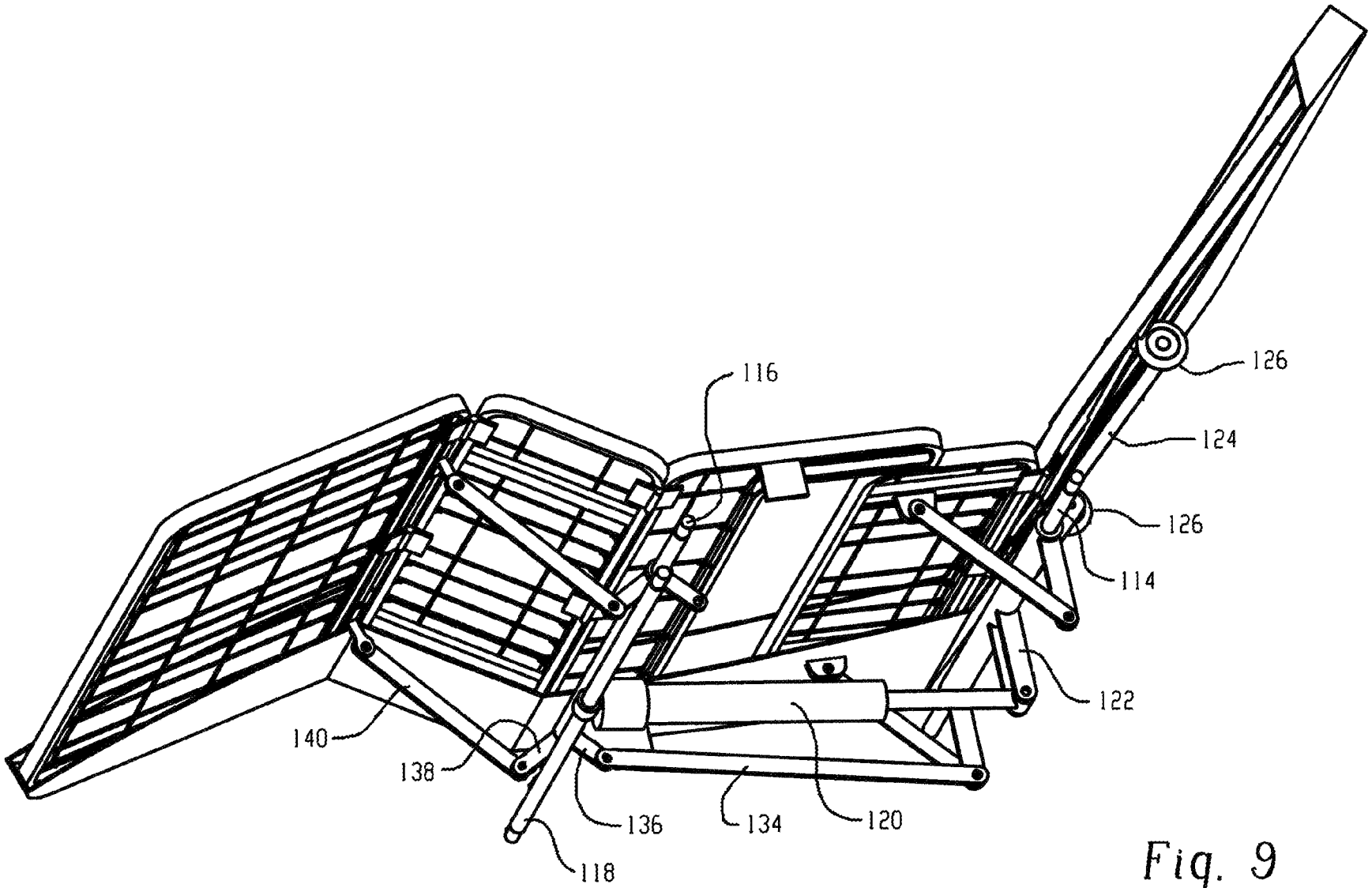
FIG. 9 is a perspective view illustrating the bottom of the mattress support surface and the linkage assembly.
Figure 10:
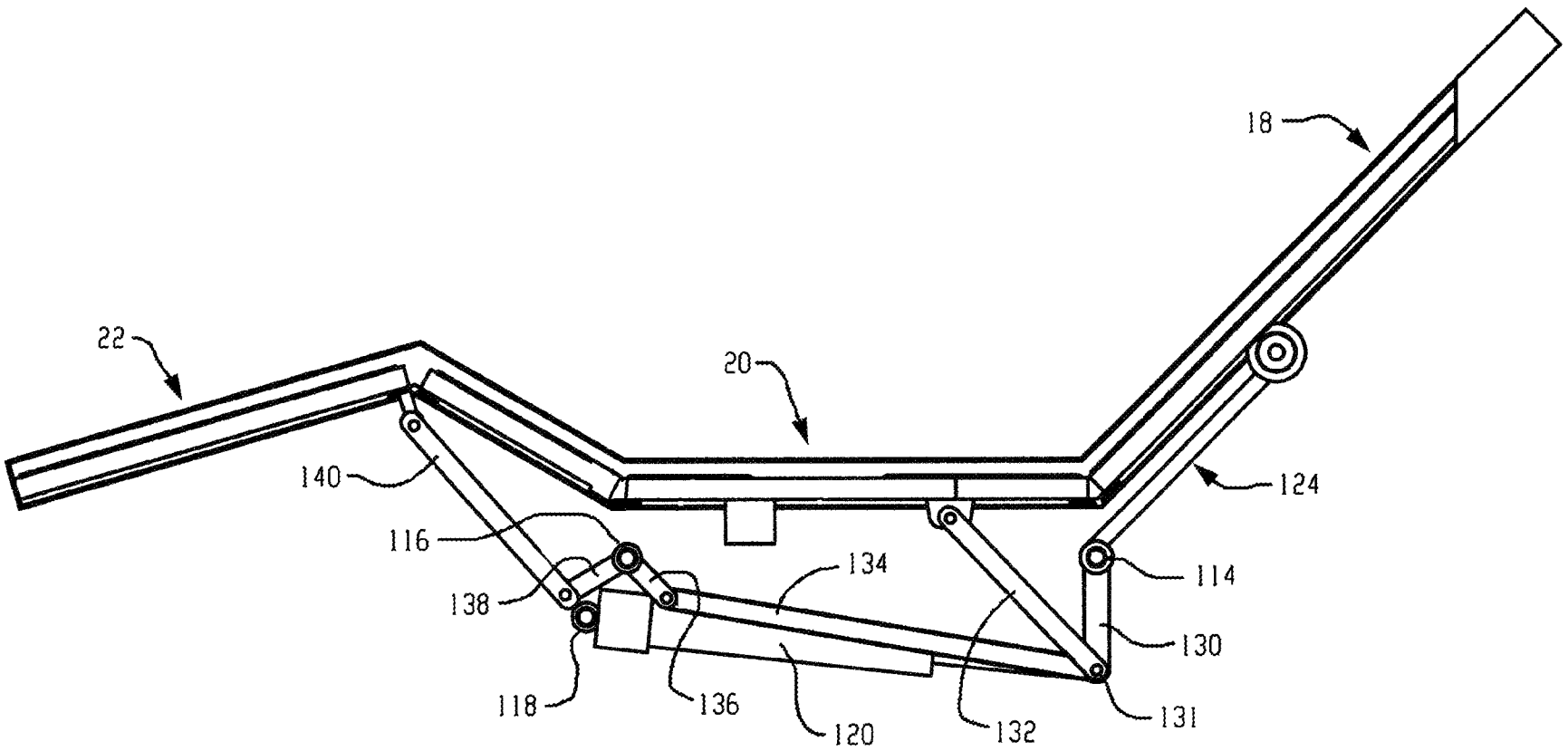
FIG. 10 is a side elevation view of the mattress support surface and the linkage assembly.

Referring now to FIGS. 8-10, the linkage assembly 16 includes a linkage support frame 100 having a dimension configured to abut or be in close proximity to the interior perimeter of the foundation frame 12. The linkage support frame 100, which is seated on cross rails 34, includes side frame members 102, 104, and transverse frame members 106, 108 attached to respective ends of the side frame members to define a rectangular shape. The side frame members 102, 104 further include two pairs of pillars 110, 112, spaced apart from one another underlying the seat section. The pillars 110, 112, are configured to receive torsional members 114, 116 extending between the side members 102, 104, which are operative with the linkage assembly 16 to articulate sections 18, 20, 22 of the adjustable foundation 12. Cross bar 118 is also attached to the side members 102, 104 as shown and is indirectly positioned underneath torsional member 116.

As shown more clearly in FIG. 10, a linear actuator 120 is attached at one end to the cross bar 118 and at the other end to crank arm 122. Crank arm 122 includes one end pivotally connected the end of the actuator 120 and the other end is fixedly attached to the torsional member 114. The linear actuator 122 includes a motor (not shown) effective to create actuator motion in a straight line so as to rotate the torsional member 114 upon extension and retraction of the linear actuator. A pair of roller arms 124 is coupled at one end to torsional member 114 and includes a roller 126 at the other end. The roller arms 124 are spaced apart from one another and aligned with the longitudinal cross members 40*a* of the head and back section 18. In this manner, upon actuation of the linear actuator 120 to effect rotational movement of the torsional member 114, the rollers 126 contact the longitudinal cross members 40*a* upon inclination and declination of the head and back section 18.

Referring now to FIG. 10, a pair of crank arms 130 is attached at about respective ends to the torsional member 114. Link arms 132 are attached to the other end of the crank arms 130 to define pivot point 131 and to the rigid frame 74 of the first portion 66 of the intermediate or seat portion 20. Upon inclination/declination of the head and back portion 18, which is hingedly connected to the first portion 66, the torsional member 114 will rotate as a consequence of the extension/retraction of the linear actuator 120, which will move the first portion 66 relative to the second portion 68, thereby increasing or decreasing the length of the intermediate or seat section 20.

Link arms 134 include an end pivotally connected to the other end of the crank arms 130 and pivotally connected at the other end to crank arm 136. The other end of crank arm 136 is coupled to torsional member 116. As a result, upon extension/retraction of the linear actuator 120, torsional member 116 will rotate in addition to torsional member 114. Crank arms 138 are coupled to the torsional member 116 and is pivotally connected at the other end to link arm 140, wherein the other end of the link arm 140 is hingedly coupled to either the first portion 86 or the second portion 88 of the leg and foot section 22 at about the hinged connection such that rotation of the torsional member 116 indirectly via linear actuator 120 will move the selected portion 86 or 88 of the leg and foot section 22 upwards or downwards depending on whether the leg and foot section is being raised or lowered. In the above described embodiment, the single actuator will provide simultaneous tilting (inclination/declination) of the head and back section 18 and tilting of the foot and leg section 22, wherein the intermediate or seat section 20 is lengthened relative to the flat position upon moving to a tilt position or shortened upon declination. Moreover, the above mechanism and configuration permits "wall hugging" placement of the mattress since the head and back section 18 pivots about a fixed axis defined by torsional member 114 and the motion and extension of the first portion 66 of the intermediate seat section 20 causes the head and back section 18 to slide towards the wall, i.e., towards a head end of the adjustable foundation assembly. By doing so, the adjustable mattress assembly, if having the head end abutting a wall, will cause the head and back section 18 to "wall hug", i.e., stay in close proximity to the wall regardless of inclination angle. Advantageously, this permits constant and easy access to a night table that may be disposed adjacent to the head and back section.

Figure 11:
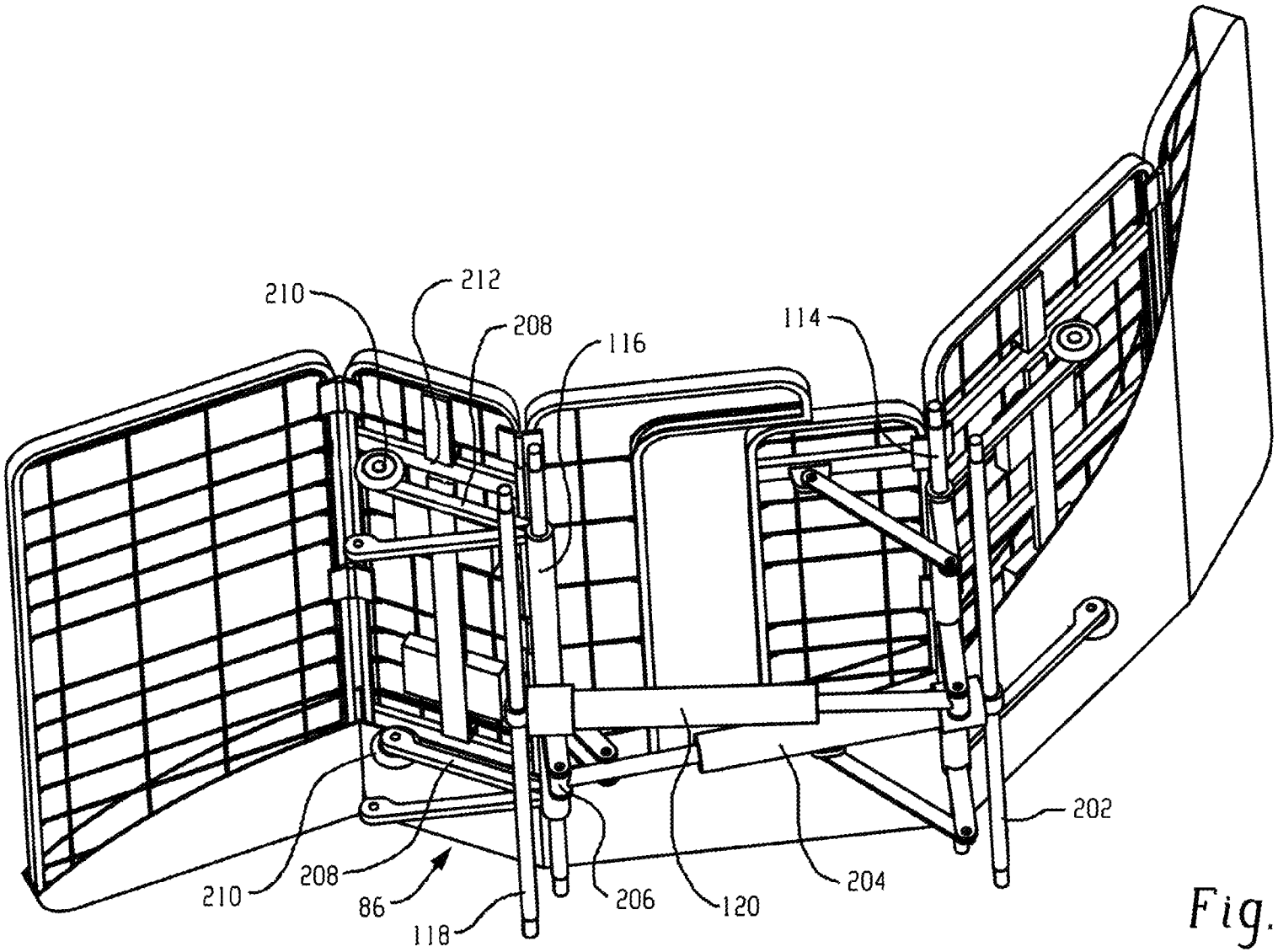
FIG. 11 is a bottom side perspective view of the mattress support surface and the linkage assembly in accordance with another embodiment.
Figure 12:
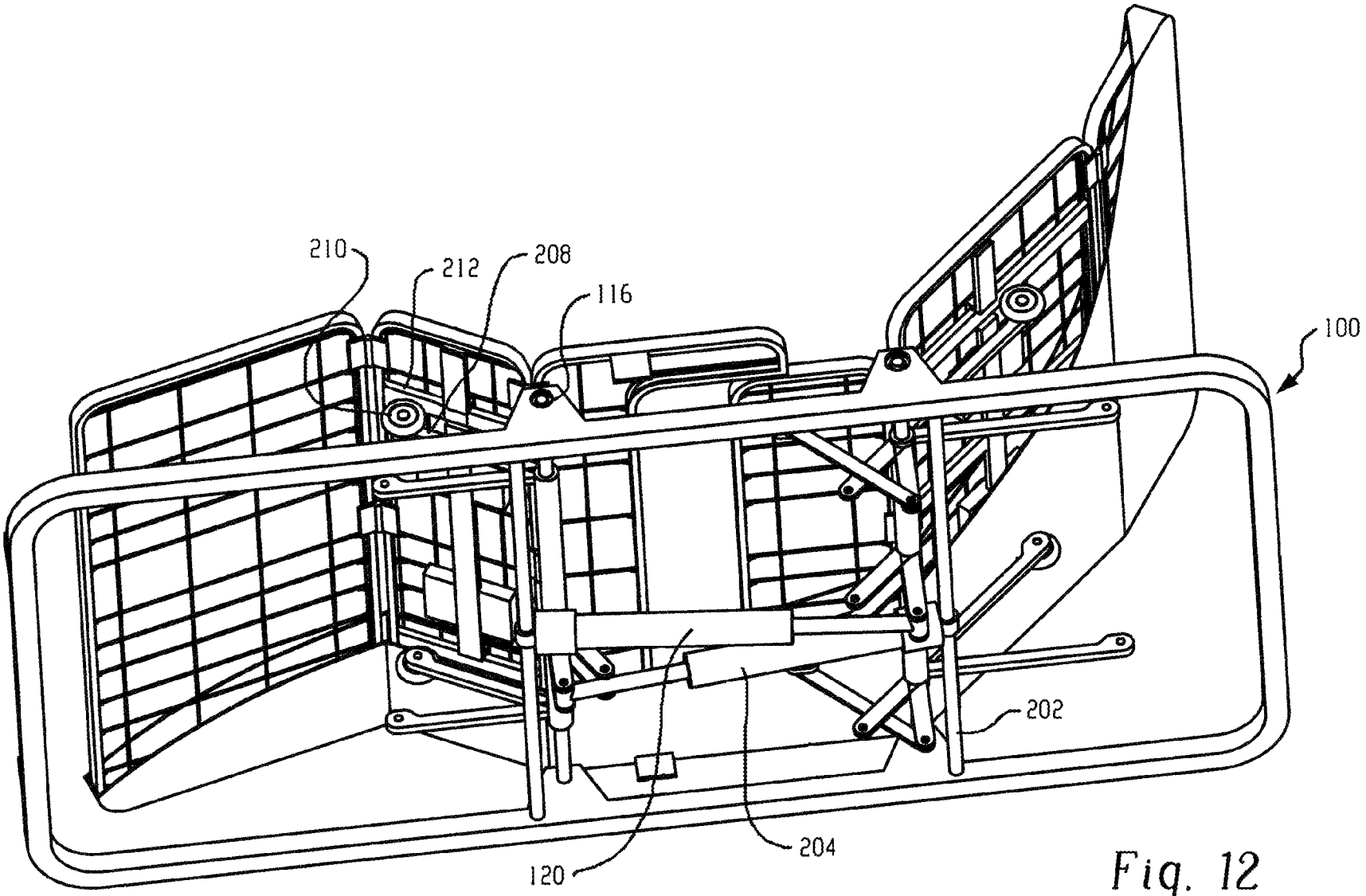
FIG. 12 is a perspective view illustrating the bottom of the mattress support surface, the linkage assembly, and linkage support frame in accordance with the embodiment of FIG. 9.
Figure 13:
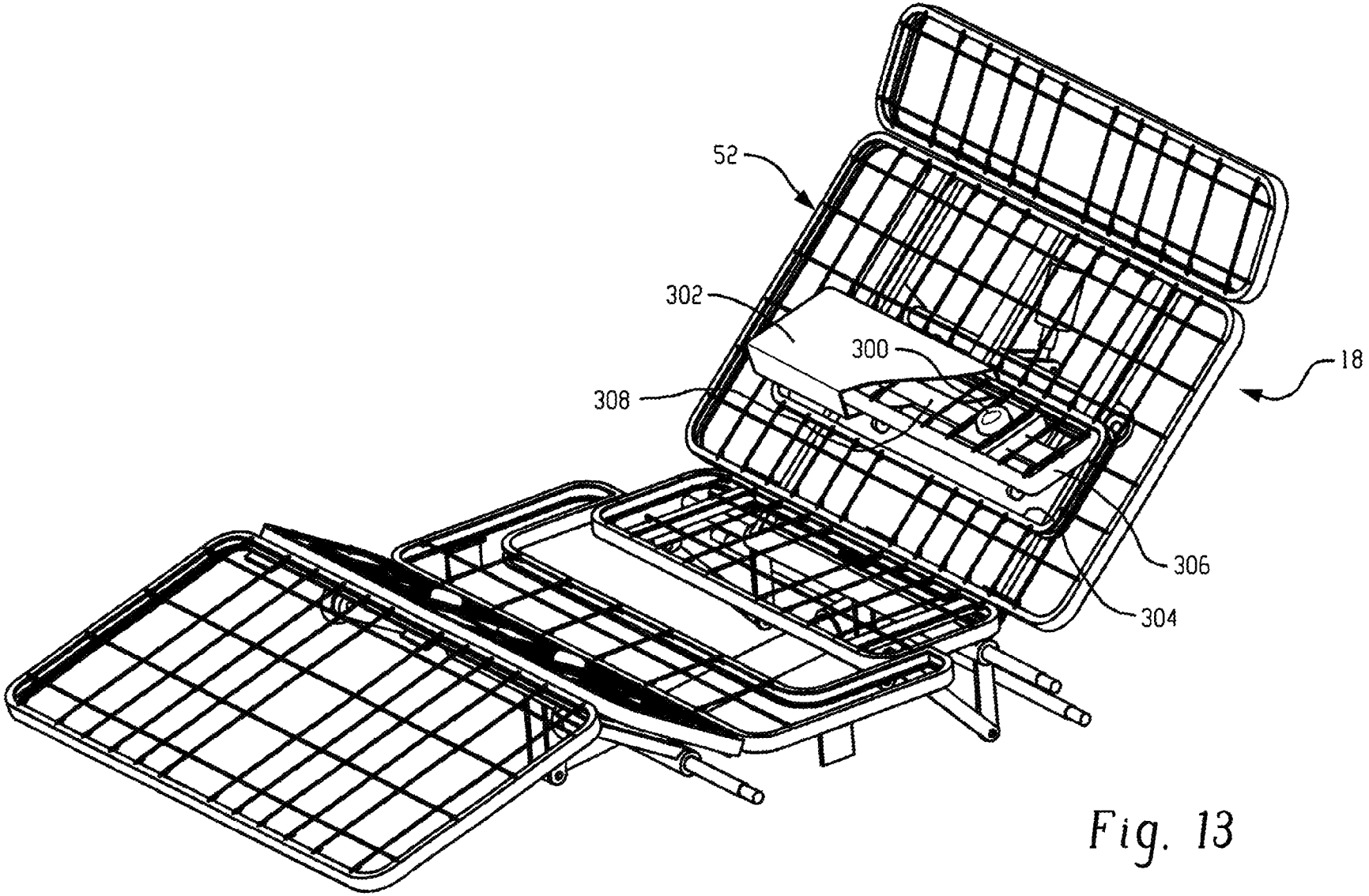
FIG. 13 is a perspective view of an adjustable foundation including a head and back section in accordance with another embodiment.
Figure 14:
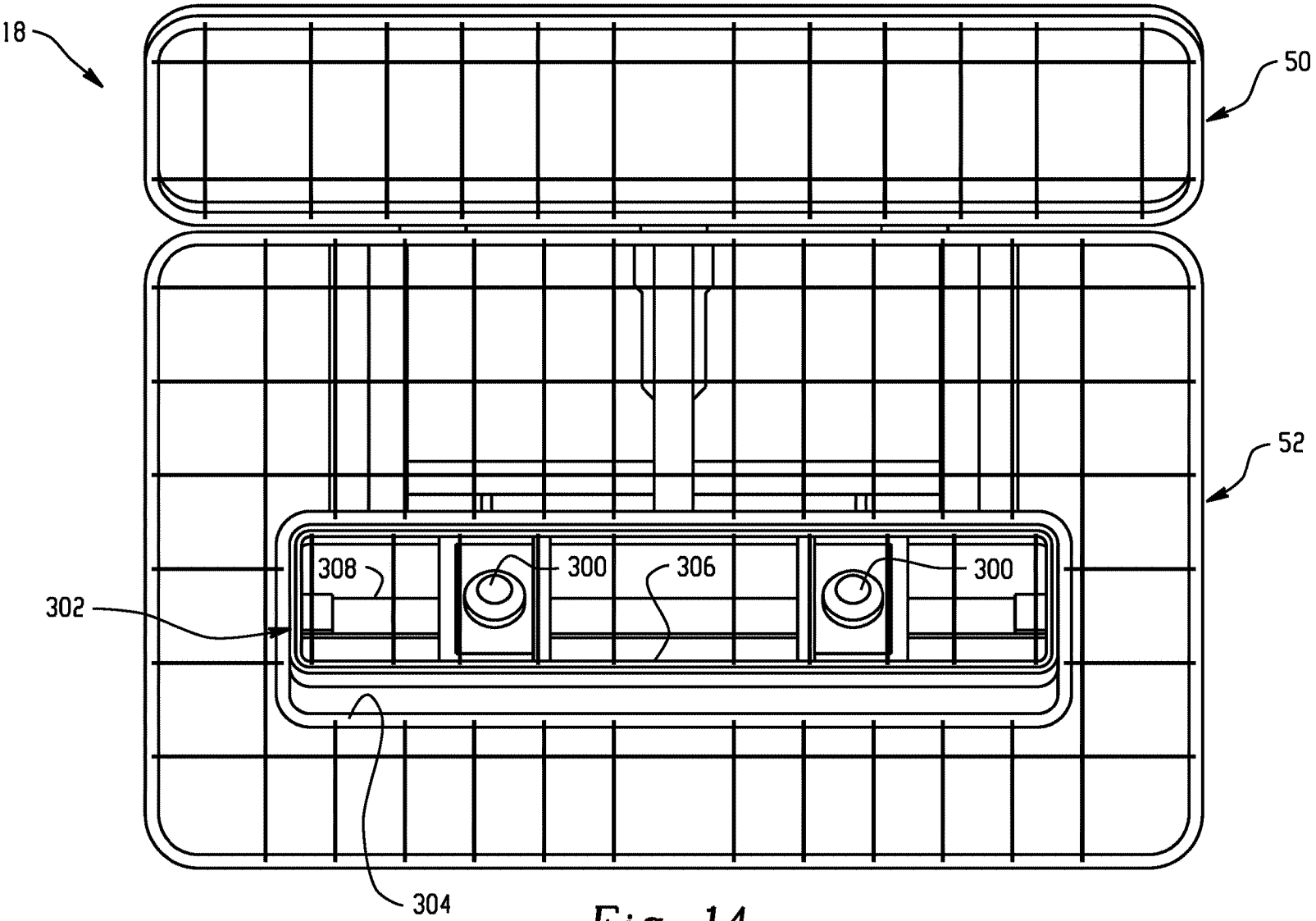
FIG. 14 is a front perspective view of the head and back section of FIG. 11.

In another embodiment shown in FIGS. 11-12, the adjustable foundation 10 includes a second actuator such that independent movement of the head and back section 18 and the leg and foot section 22 can be effected. In this embodiment, the mattress support frame 100 includes an additional cross bar 202 extending between side members 102, 104 and generally positioned underlying torsional member 114. A second linear actuator 204 is attached at one end to the cross bar 202 and pivotally connected at the other end to crank arm 206. Crank arm 206 is coupled at the other end to torsional member 116. Similar to the first linear actuator 120, the second linear actuator 204 includes a motor (not shown) effective to create actuator motion in a straight line so as to rotate the torsional member 116 upon extension and retraction of the linear actuator. A pair of roller arms 208 is coupled at one end to torsional member 116 and includes a roller 210 at the other end. The roller arms 208 are spaced apart from one another, wherein the roller arms 208 are aligned with the longitudinal cross members 210 in the first portion 86 of the leg and foot section 22. In this manner, upon selective actuation of the second linear actuator 204 to effect rotational movement of the torsional member 116, the rollers 210 contact the longitudinal cross members 212 upon inclination and declination of the head and back section 18.

In this embodiment, the first linear actuator 120 is free of crank arms 136, 138 and link arms 134, which were operable to articulate the leg and foot section 22 in the embodiment described above. As a result, selective actuation of the first linear actuator 120 is operative to move the first portion 66 of the intermediate or seat section 20 and effect inclination or declination of the head and back section 18. The end user then has the choice of selective actuation of the first and/or second linear actuators 120 and/or 204, respectively, to provide the desired positioning of the mattress support surface 14.

In still another embodiment shown in FIGS. 13-16, the head and back section 18 includes a vibratory unit generally designated 300 coupled to a lumbar support member 302. The head and back section 18 includes a rectangular shaped opening 304 in the second portion 52 and a lumbar support member 302 within the opening 304. The lumbar support member 302 includes a rectangular shaped rigid frame 306 hingedly connected at a top end of the opening 304 to the second portion 52. The rectangular rigid frame may be selectively raised as shown or coplanar relative to the first portion 52. In this manner, the vibratory units 300, which are coupled to the lumbar support member 302, can be moved upwardly at an arc so that the vibratory unit may maintain contact and effectiveness with a mattress disposed thereon.

The rigid frame 306 further includes a transverse cross member 308 extend therebetween. Vibratory units 300, two of which are shown, are coupled to the transverse cross bar 308. However, it should be apparent that more or less vibratory units 300 can be utilized.

The vibratory unit 300 generally includes a variable speed motor with a shaft and an eccentric weight attached to the shaft causing the motor to vibrate when in use. The frequency of the vibrations produced within the mattress may be controlled by varying the speed of each motor. The amplitude of the vibration may be controlled by re-positioning the eccentric weight. Operation of the individual vibrating units thusly imparts a resonating effect to the mattress and to a person reclining upon the mattress. By varying the frequencies of the vibratory impulses and the level of resonance, a person may recline upon the mattress for its comforting effects or, alternatively, be slowly lulled to sleep.

Figure 15:
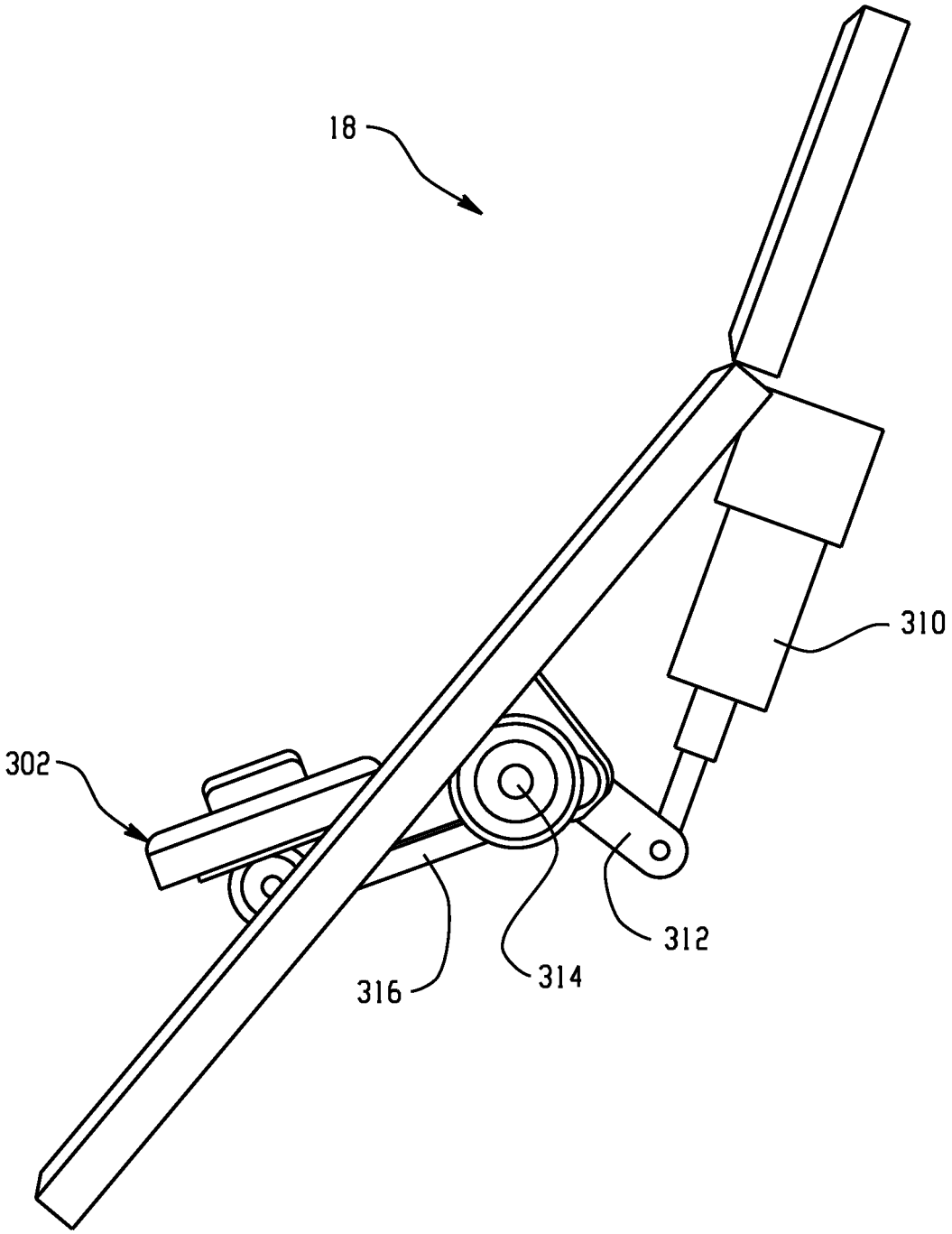
FIG. 15 is a side perspective view of the head and back section of FIG. 11.
Figure 16:
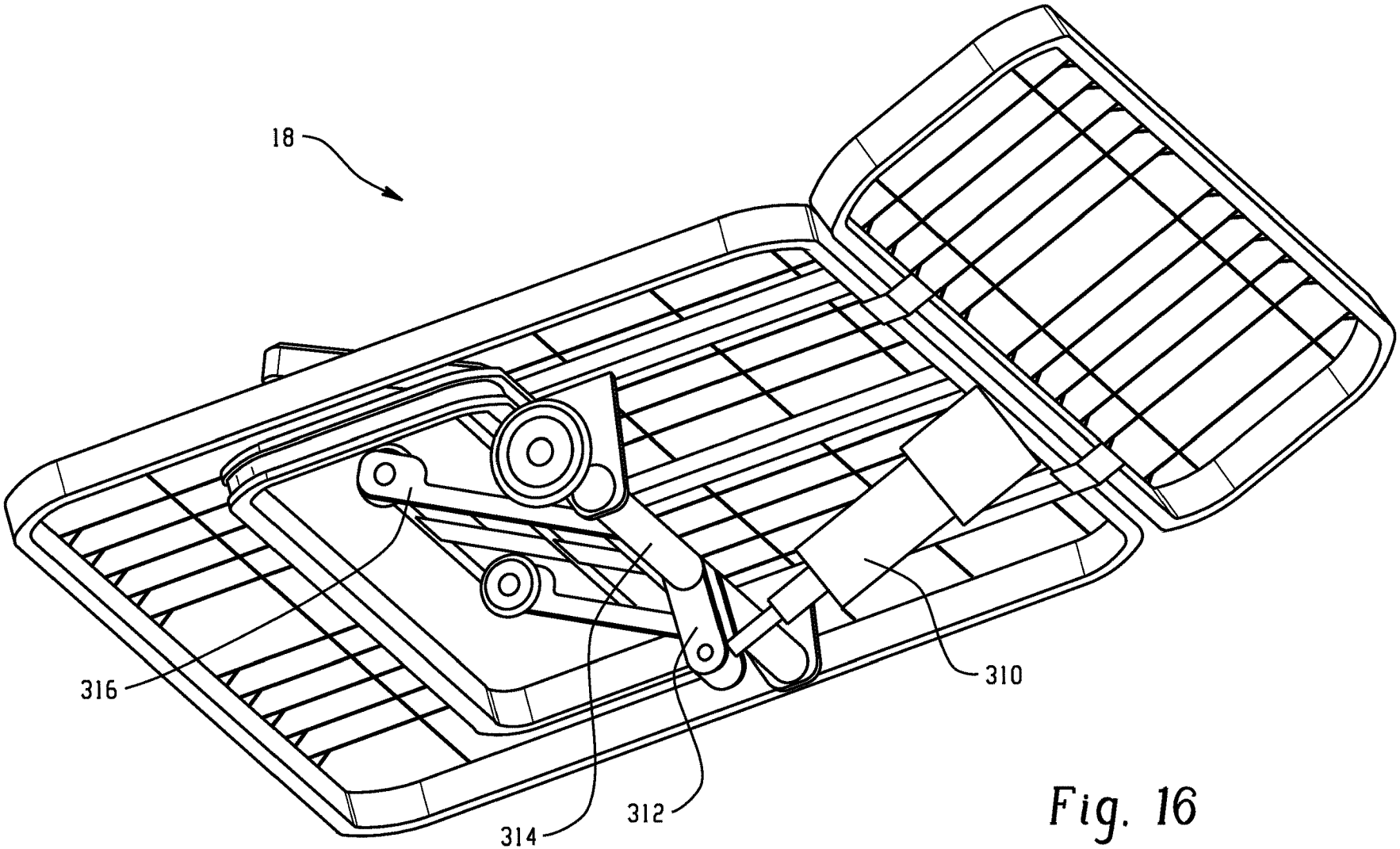
FIG. 16 is a back perspective view of the head and back section of FIG. 11.

As shown more clearly in FIG. 15, the lumbar support member 302 can be articulated via actuator 310. The actuator 310 is coupled to a crank arms 312 attached to a torsional member 314. Roller arms 316 are coupled to the torsional member 314 such that the extension or retraction of the actuator, e.g., a linear actuator, effects rotation of the torsional member via crank arms 312, which effects inclination declination of the lumbar support member 302.

It should be apparent that any of the section 18, 20, and 22 of the adjustable foundation can be modified to include a vibratory unit such as described above. By way of example, vibratory units can be coupled to the first portion 86 of the leg and foot section 22.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A coil spring mattress and adjustable foundation assembly, comprising:

a coil spring mattress; and an adjustable foundation frame comprising:

side frame members and transverse frame members attached at respective ends of the side frame members to define a generally rectangular shape, and at least one cross rail extending between the side frame members;

a mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section; and a first actuator having an extending and retracting member operatively coupled to a linkage assembly to effect inclination or declination of the head and back section relative to the intermediate seat section and inclination or declination of the foot and leg section, wherein the first actuator is further operative to effect an increase or decrease in a length of the intermediate seat section by movement of the first portion relative to the second portion.

2. The adjustable mattress assembly of claim 1, wherein the leg and foot section comprise a first portion hingedly connected to a second portion, wherein the second portion is hingedly connected to the intermediate seat section.

3. The adjustable mattress assembly of claim 1, wherein the linkage assembly comprises a linkage support frame configured to be seated on the foundation frame; first and second spaced apart torsional members coupled to the linkage support frame underlying each end of the intermediate seat section; a cross bar coupled to the linkage support frame and underlying a selected one of the first and second torsional members, and link arms having an end pivotally connected to crank arms coupled to the first and/or second torsional members, wherein the first actuator has one end coupled to the cross rail and another end coupled to one of the crank arms effective to rotate the torsional member upon extension and retraction of the first actuator and effect inclination or declination of the head and back section and the leg and foot section.

4. The adjustable mattress assembly of claim 1, wherein the head and back section comprise a first portion and a second portion, wherein the second portion is hingedly connected at one end to the first portion and at another end is hingedly connected to the intermediate seat section, wherein the first portion is pivotally moveable from the second portion via a third actuator operatively coupled thereto.

5. The adjustable mattress assembly of claim 4, wherein the second portion of the head and back section further comprises a rectangular shaped lumbar support member disposed within a complementary shaped opening in the second portion, wherein the lumbar support member is hingedly connected at a top end and operative with a fourth actuator coupled thereto to pivot upwardly relative to the second portion, wherein at least one vibratory unit is coupled to the lumbar support member.

6. The adjustable mattress assembly of claim 1, wherein the mattress support surface further comprises at least one vibratory unit coupled thereto.

7. The adjustable mattress assembly of claim 1, wherein the first portion of the intermediate seat section is rectangularly shaped and the second portion of the intermediate seat section is generally u-shaped such that upon extension and retraction of the first actuator, the first portion of the intermediate seat section moves towards or away from an opening defined by the u-shaped second portion, thereby lengthening or shortening the intermediate seat section.

8. The adjustable mattress assembly of claim 1, wherein the increase in the length of the intermediate seat section by movement of the first portion relative to the second portion slides the head and back section toward an end of the adjustable mattress assembly.

9. A coil spring mattress and adjustable foundation assembly, comprising:

a coil spring mattress; and an adjustable foundation frame comprising:

side frame members and transverse frame members attached at respective ends of the side frame members to define a generally rectangular shape, and at least one cross rail extending between the side frame members;

a mattress support surface including a head and back section hingedly connected to an intermediate seat section at one end and a leg and foot section hingedly connected to the intermediate seat section at another end, wherein the intermediate seat section includes a first portion and a second portion, wherein the first portion is hingedly connected to the head and back section and the second portion is hingedly connected to the leg and foot section;

a first actuator underlying the intermediate seat section having an extending and retracting member operatively coupled to a linkage assembly to effect selective inclination or declination of the head and back section relative to the intermediate seat section, wherein the first actuator is further operative to effect an increase or decrease in a length of the intermediate seat section by movement of the first portion relative to the second portion, and wherein the linkage assembly comprises a linkage support frame configured to be seated on the foundation frame; first and second spaced apart torsional members coupled to the linkage support frame underlying each end of the intermediate seat section; cross bars coupled to the linkage support frame and underlying each of the first and second torsional members, and link arms having an end pivotally connected to crank arms coupled to the first and/or second torsional members, wherein the first actuator has one end coupled to one of the cross bars and another end coupled to one of the crank arms effective to rotate the first torsional member upon extension and retraction of the first actuator and effect inclination or declination of the head and back section; and a second actuator having an extending and retracting member operatively coupled to the linkage assembly to effect selective inclination or declination of the leg and foot section.

10. The adjustable mattress assembly of claim 9, wherein the leg and foot section comprise a first portion hingedly connected to a second portion, wherein the second portion is hingedly connected to the intermediate seat section.

11. The adjustable mattress assembly of claim 9, wherein the second actuator has one end coupled to the other cross bar and another end coupled to one of the crank arms effective to rotate the second torsional member upon extension and retraction of the second actuator and effect inclination or declination of the leg and foot section.

12. The adjustable mattress assembly of claim 9, wherein the head and back section comprise a first portion and a second portion, wherein the second portion is hingedly connected at one end to the first portion and at another end is hingedly connected to the intermediate seat section, wherein the first portion is moveable from the second portion via a third actuator operatively coupled thereto.

13. The adjustable mattress assembly of claim 12, wherein the second portion of the head and back section further comprises a rectangular shaped lumbar support member disposed within a complementary shaped opening in the second portion, wherein the lumbar support member is hingedly connected at a top end and operative with a fourth actuator coupled thereto to pivot upwardly relative to the second portion, wherein at least one vibratory unit is coupled to the lumbar support member.

14. The adjustable mattress assembly of claim 9, wherein the mattress surface further comprises at least one vibratory unit coupled thereto.

15. The adjustable mattress assembly of claim 9, wherein the first portion of the intermediate seat section is rectangularly shaped and the second portion of the intermediate seat section is generally u-shaped such that upon extension and retraction of the first actuator, the first portion of the intermediate seat section moves towards or away from an opening defined by the u-shaped second portion, thereby lengthening or shortening the intermediate seat section.

16. The adjustable mattress assembly of claim 9, wherein the increase in the length of the intermediate seat section by movement of the first portion relative to the second portion slides the head and back section toward an end of the adjustable mattress assembly.

* * * * *